US010124553B2

(12) United States Patent
Moszumański et al.

(10) Patent No.: US 10,124,553 B2
(45) Date of Patent: Nov. 13, 2018

(54) UNIVERSAL METHOD AND A DEVICE FOR SUPPORTING THE PROCESS OF PRESS MOULDING OF FINELY FRAGMENTED MATERIALS BY MEANS OF MECHANICAL VIBRATIONS

(71) Applicants: Ryszard Moszumański, Kraków (PL); Maciej Moszumański, Kraków (PL)

(72) Inventors: Ryszard Moszumański, Kraków (PL); Maciej Moszumański, Kraków (PL)

(73) Assignee: Politechnika Krakowska im. Tadeusza Kosciuszki, Cracow (PL)

( * ) Notice: Subject to any disclaimer, the term of this patent is extended or adjusted under 35 U.S.C. 154(b) by 931 days.

(21) Appl. No.: 14/464,055

(22) Filed: Aug. 20, 2014

(65) Prior Publication Data

US 2015/0174846 A1 Jun. 25, 2015

(30) Foreign Application Priority Data

Dec. 24, 2013 (PL) ..... P.406693

(51) Int. Cl.
*B30B 11/02* (2006.01)
*B30B 11/04* (2006.01)

(52) U.S. Cl.
CPC ..... *B30B 11/022* (2013.01); *B30B 11/04* (2013.01)

(58) Field of Classification Search
None
See application file for complete search history.

(56) References Cited

U.S. PATENT DOCUMENTS 3,810,417 A * 5/1974 Sieke ..... B06B 1/183 137/624.13
4,140,744 A * 2/1979 Karas ..... B28B 3/022 264/72
4,421,471 A * 12/1983 Vogt ..... B28B 3/022 425/135

* cited by examiner

*Primary Examiner* — Matthew J Daniels
*Assistant Examiner* — Mohammad M Ameen
(74) *Attorney, Agent, or Firm* — Horst M. Kasper, Esq

(57) ABSTRACT

The subject of the invention is a universal method and a device for supporting the process of press moulding of finely fragmented materials by means of mechanical vibrations. The device comprises a motor driving, via a belt transmission, the flow pulse generator (3) connected permanently with actuator. The feeding for flow pulse generator (3) is supplied to port (6), and the outflow to the reservoir occurs via port (7). On the circumference of rotor (17) of the flow pulse generator (3), a plurality of grooves is made. Groove (10), on one side, is connected permanently with passage of port (6), and on the other side, depending on position of rotor (17), it can be connected with arms of the flow guide, Groove (9), on one side, is connected permanently with passaoe of port (7), and on the other side, depending on position of rotor (17), it can be connected with arms of the flow guide. Passage (12) depending on position of rotor (17), is connected directly with groove (8) or with groove (9). Passage (12) is connected with space (13) above the acmator piston. Passage (14), depending on position of rotor (17), is connected directly with groove (10) or with groove (11). Passage (14) is connected with, space (16) under the actuator piston (5). Grooves (8) and (9) are separated from grooves (10) and (11). The unit generating mechanical vibrations is characterised with low flow resistance and high tightness which ensures high energy efficiency and low level of noise emitted by the device.

4 Claims, 5 Drawing Sheets

UNIVERSAL METHOD AND A DEVICE FOR SUPPORTING THE PROCESS OF PRESS MOULDING OF FINELY FRAGMENTED MATERIALS BY MEANS OF MECHANICAL VIBRATIONS

The subject of the present invention is a method and a device for supporting the process of press moulding of finely fragmented materials by means of mechanical vibrations.

Commonly known and used devices for generating mechanical vibrations are hydraulic liquid pulsation generators comprising a piston located in a cylinder and driven with an eccentric or a cam mechanism. The piston moving under pressure of a cam forces pressure changes in liquid contained in a cylinder with a frequency equalling to this of the reciprocal motion of the piston. Known are also hydraulic generators equipped with elements controlling flow of a liquid given a form of a piston, a disc, or a sleeve. The piston-like control element is a slide distributor. Control elements in the form of a disc or a sleeve have holes made on their perimeters through which a working liquid is periodically discharged from the working space or supplied to working spaces of a hydraulic actuator. Known is also a hydraulic liquid pulsation generator with design based on a rotating distributor with distribution rotor mounted on bearings in a housing and provided with two recesses turned on its circumference. The space inside recesses is connected with inflow and outflow passages, while the outer surface of the rotor has grooves made parallel to the rotor axis and connected alternately with spaces inside recesses turned in the rotor. In a side portion of the body, a slit is made through which the pulsating stream of liquid is led out to a hydraulic actuator.

A flaw of the solutions employing a control element in the form of an eccentric or a cam is the low achievable pulsation frequency limited by inertia of the piston demonstrated in its reciprocal motion, and in case of designs with the control element in the form of a disc or a bushing, achieving high flow rates and higher pulsation frequencies results in significant increase of dimensions of the device. These flaws are absent in the design with rotating distribution rotor, provided that the problem will be solved of flow resistance which is the main obstacle in reaching higher flow rates and higher frequencies with the noise emitted by the device kept at an acceptable level.

The objective of the present invention is to provide a method and a compact efficient device for supporting the process of press moulding of finely fragmented materials by means of mechanical vibrations with high amplitude and large frequency.

The essence of the universal method and the device for supporting the process of press moulding of finely fragmented materials by means of mechanical vibrations is characterised in that the force unit comprises a main actuator, a hydraulic vibrator, main table lower body yoke, a thrust table, posts, four columns, a lower punch plate, and a punch. The main actuator favourably transfers the quasi-static pressing force onto the main table and further, via four columns, to the lower punch plate, whereas the thrust table is connected permanently by means of posts with the lower body yoke, while the thrust table carries a hydraulic vibrator permanently connected with the thrust table, and hydraulic vibrator transfers the additional dynamic force to the lower punch plate. It is also favourable that the grooves of two types, on one side, are connected permanently with passage of the port, and on the other side, depending on position of the rotor, can be connected with one of two arms of the flow guide. It is further favourable that the passage, depending on position of the rotor, is connected directly with one of the alternately located grooves, while the passage is connected with the space above the actuator's piston, and the passage, depending on position of the rotor, is connected directly with another one of the alternately located grooves, while the passage is connected with the space under the actuator's piston. Further, it is favourable that alternately located grooves are separated from each other by means of a sealing ring with locks. It is also favourable that alternately distributed grooves are tightly separated from each other by separators distributed on circumference of the rotor and pressed against the flow pulse generator body by the centrifugal force.

The merit of the invention consists in obtaining a quasi-static pressing force exerted by a moulding press, such force being superposed with an additional dynamical force of large amplitude and high frequency. The unit generating mechanical vibrations is characterised with low resistance of flow and high tightness which ensure high energy efficiency and low level of the noise emitted by the device.

An example embodiment of the invention is shown in FIG. 1, FIG. 2, FIG. 3, FIG. 4, and FIG. 5.

DETAILED DESCRIPTION OF THE INVENTION

Figure 1:
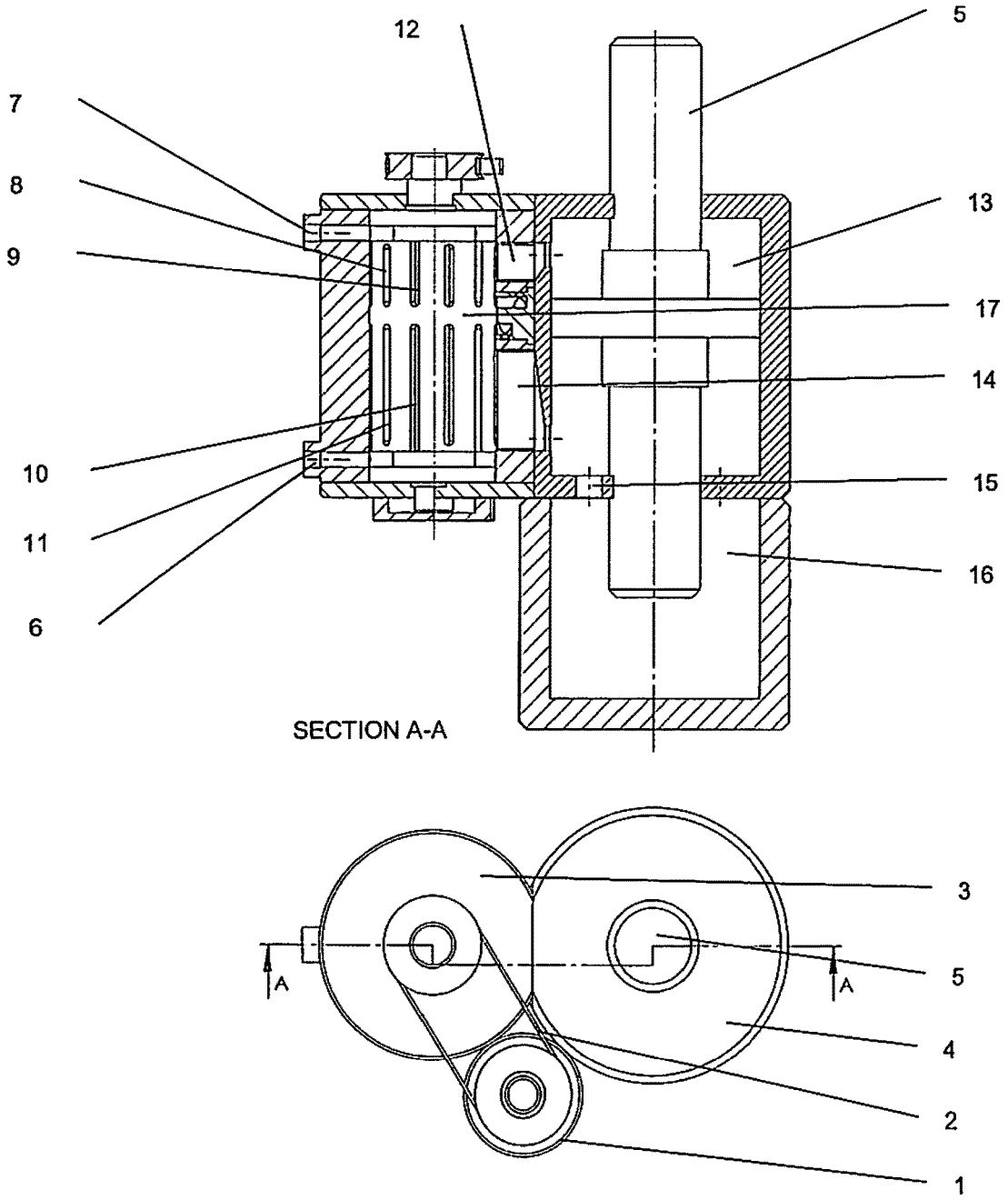
FIG. 1 shows the axial cross-section and top view of the device for supporting processes of press moulding of finely fragmented materials by means of mechanical vibrations.
Figure 2:
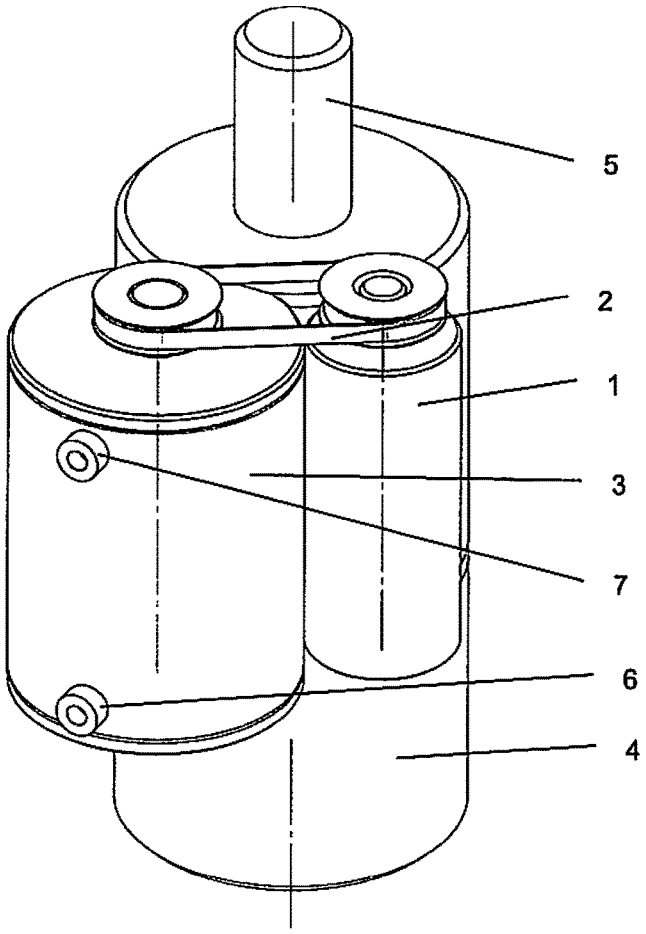
FIG. 2 shows the axonometric view of a device for supporting processes of press moulding of finely fragmented materials by means of mechanical vibrations.

The device for supporting the process of press moulding of finely fragmented materials by means of mechanical vibrations comprises motor (1) FIG. 2 driving, via a belt transmission (2) FIG. 2, the flow pulse generator (3) FIG. 2 connected permanently with the actuator (4) FIG. 2. The feeding inlet for the flow pulse generator (3) FIG. 1 is connected to port (6) FIG. 1, and the outflow to the reservoir occurs via port (7) FIG. 1. The circumference of rotor (17) FIG. 1 of the flow pulse generator (3) FIG. 1 is provided with a plurality of grooves. Groove (10) FIG. 1, on one side, is connected permanently with passage of port (6) FIG. 1, and on the other side, depending on position of rotor (17) FIG. 1, it can be connected with arm (19) FIG. 3 or with arm (20) FIG. 3 of flow guide (18) FIG. 3, while groove (9) FIG. 1, on one side, is connected permanently with passage of port (7) FIG. 1, and on the other side, depending on position of rotor (17) FIG. 1, can be connected with arm (21) FIG. 3 or with arm (22) FIG. 3 of flow guide (18) FIG. 3. Passage (12) FIG. 1, depending on position of rotor (17) FIG. 1, is connected directly with groove (8) FIG. 1 or with groove (9) FIG. 1. Passage (12) FIG. 1 is connected with space (13) FIG. 1 over the actuator piston (5) FIG. 1. Passage (14) FIG. 1 depending on position of rotor (17) FIG. 1 is connected directly with groove (10) FIG. 1 or with groove (11) FIG. 1. Passage (14) FIG. 1 is connected with space (16) FIG. 1 under the actuator piston (5) FIG. 1. Grooves (8) FIG. 1 and (9) FIG. 1 are separated from grooves (10) FIG. 1 and (11) FIG. 1 by means of sealing ring (23) FIG. 4 with locks (24) FIG. 4. Alternately distributed grooves (8) FIG. 4 and (9) FIG. 4 are tightly separated from each other by means of separators (25) distributed on circumference of rotor (17) FIG. 1 and pressed against the body (26) FIG. 4 of flow pulse generator (3) FIG. 1 by means of the centrifugal force.

Figure 3:
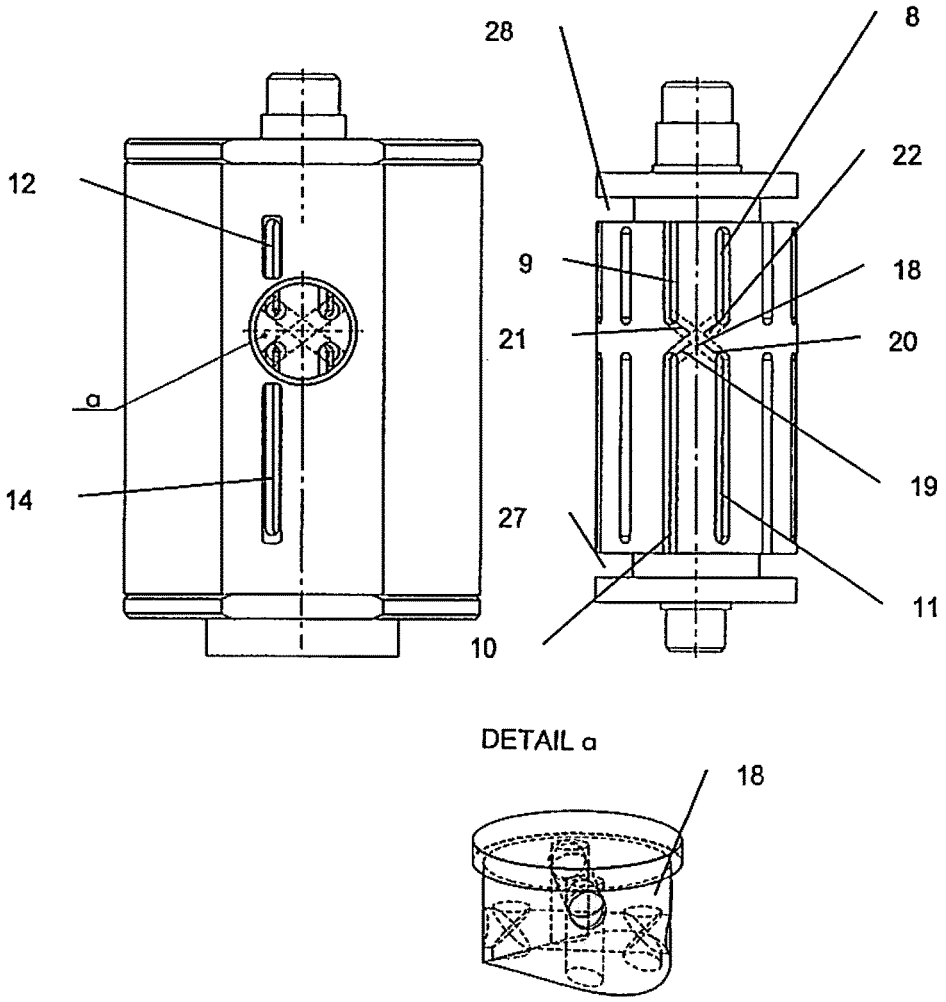
FIG. 3 shows a view of the rotor body and the steering wheel of the device for supporting processes of press moulding of finely fragmented materials by means of mechanical vibrations.
Figure 4:
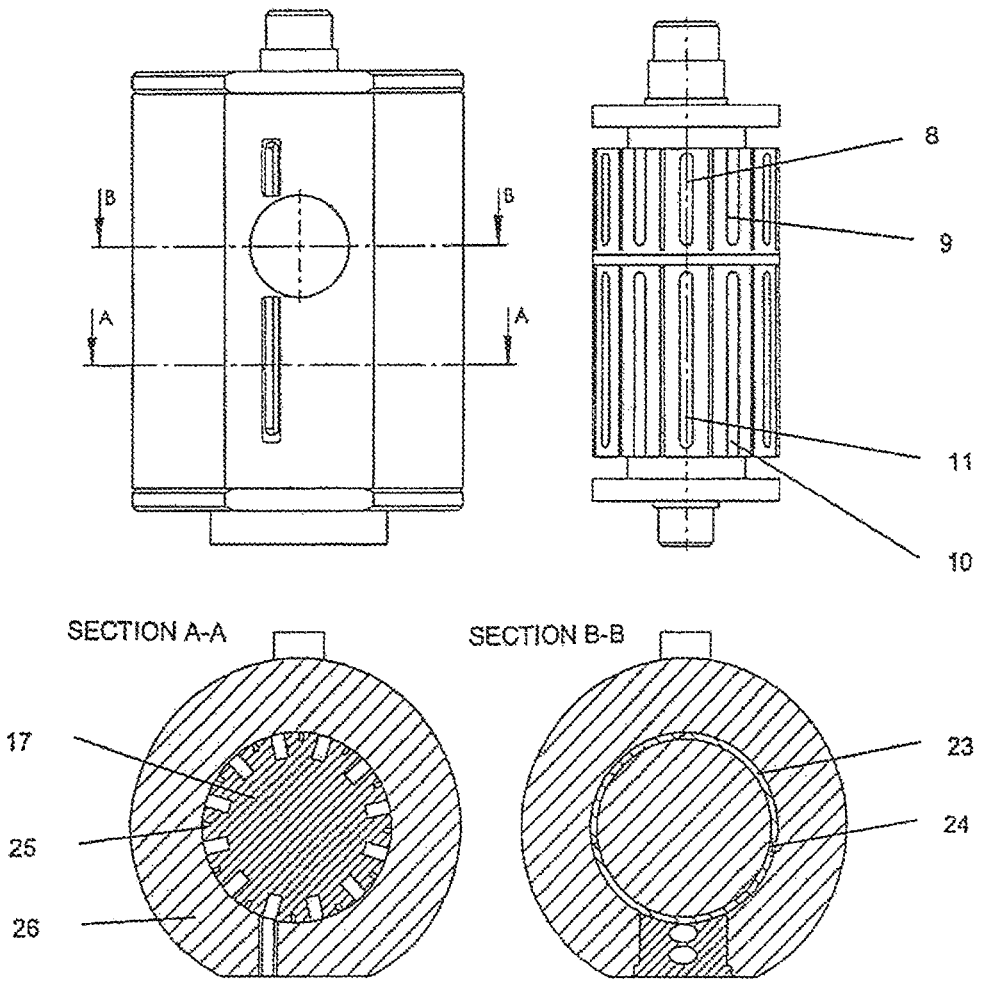
FIG. 4 shows a view of the rotor body and two cross-sections perpendicular to the axis of the device for supporting processes of press moulding of finely fragmented materials by means of mechanical vibrations.

The principle of the pulsating stream direction change is presented in FIG. 3. The feed stream from space (27) FIG. 3 reaches groove (10) FIG. 3 of rotor (17) FIG. 3. As the groove (10) FIG. 3 in this position of rotor (17) FIG. 3 is positioned against slit (14) FIG. 3, the feed stream flows through slit (14) FIG. 3 and further to space (16) FIG. 1 under piston (5) FIG. 1. Outflow from space (13) FIG. 1 over the piston occurs through slit (12) FIG. 3 and via the oppositely positioned groove (9) FIG. 3 of rotor (17) FIG. 3 to the outflow space (28) FIG. 3. After the rotor being turned by the angle corresponding to the pitch of grooves, the feed stream from space (27) FIG. 3 reaches groove (11) FIG. 3 of rotor (17) FIG. 3 and further through arm (20) FIG. 3 of flow guide (18) FIG. 3 and arm (21) FIG. 3 of flow guide (18) FIG. 3 to groove (8) FIG. 3 of rotor (17) FIG. 3. As the groove (8) FIG. 3 in this position of rotor (17) FIG. 3 is positioned against the slit (12) FIG. 3, the feed stream flows through slit (12) FIG. 3 and further to space (13) FIG. 1 over piston (5) FIG. 1. Outflow from space (16) FIG. 1 under the piston occurs through slit (14) FIG. 3, via groove (8) FIG. 3 positioned against the slit, and further through arm (19) FIG. 3 of flow guide (18) FIG. 3 and arm (22) FIG. 3 of flow guide (18) FIG. 3 to groove (9) FIG. 3 of rotor (17) FIG. 3.

Figure 5:
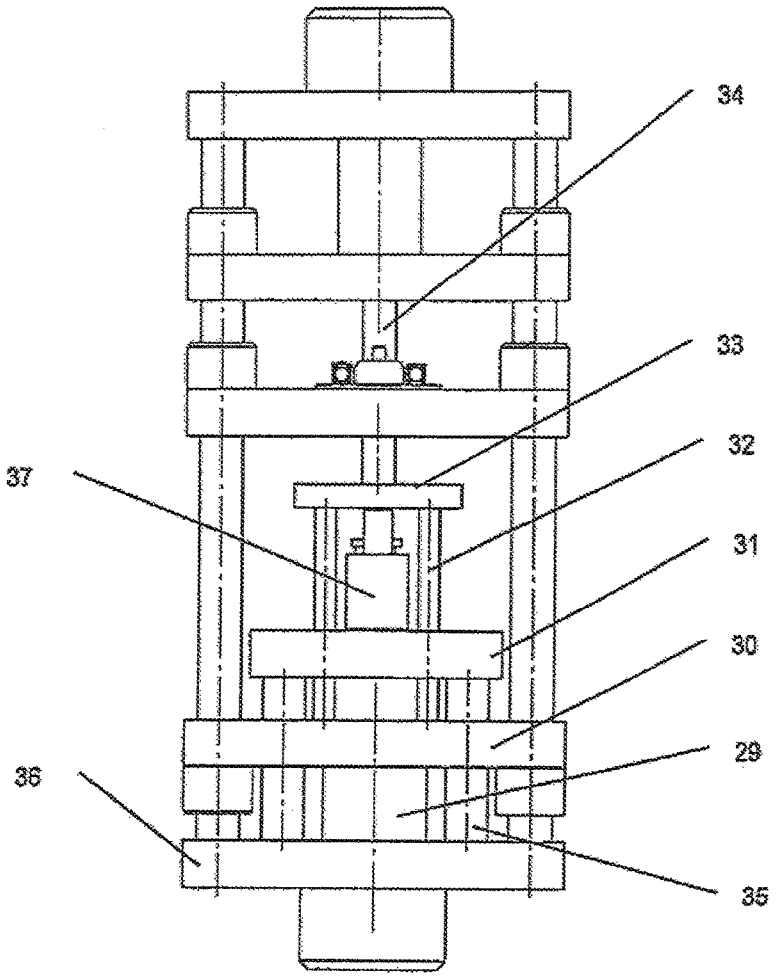
FIG. 5 shows a view of the device for supporting processes of press moulding of finely fragmented materials by means of mechanical vibrations.

The process of superposing the quasi-static pressing force exerted by the actuator with an additional dynamic force is accomplished in the force unit shown in FIG. 5. The force unit comprises a main actuator (29) FIG. 5, hydraulic vibrator (37) FIG. 5, yoke (36) FIG. 5 of lower body of the main table (30) FIG. 5, thrust table (31) FIG. 5, posts (35) FIG. 5, four columns (32) FIG. 5, lower punch plate (33) FIG. 5, and punch (34) FIG. 5.

Main actuator (29) FIG. 5 transfers the quasi-static pressing force to main table (30) FIG. 5 and further by means of four columns (32) FIG. 5 to lower punch plate (33) FIG. 5. Thrust table (31) FIG. 5 is permanently connected by means of posts (35) FIG. 5 with lower body yoke (36) FIG. 5. On thrust table (31) FIG. 5, hydraulic vibrator (37) FIG. 5 is located and permanently connected with thrust table (31) FIG. 5. The hydraulic vibrator transfers the additional dynamic force to lower punch plate (33) FIG. 5.

The method of application and the compact effective device for supporting the process of press moulding of finely fragmented materials by means of mechanical vibrations with large amplitude and high frequency, with its noise kept at a low level, may find wide application in industrial practice as a basic component of special pulsation presses or special pulsation equipment of classical presses.

The invention claimed is:

1. The device for supporting the process of press molding of finely fragmented materials by means of mechanical vibrations characterized in that a force unit comprises main actuator (29), hydraulic vibrator (37), yoke (36) of the lower body of main table (30), thrust table (31) of posts (35), four columns (32), lower punch plate (33), and punch (34), wherein a main actuator (29) transfers a quasi-static pressing force to main table (30) and further by means of four columns (32) to lower punch plate (33), whereas thrust table (31) is permanently connected by means of posts (35) with the lower body yoke (36), while thrust table (31) carries hydraulic vibrator (37) permanently connected with thrust table (31), and a hydraulic vibrator transfers a additional dynamic force to lower punch plate (33), wherein groove (10), on one side, is connected permanently with passage of port (6), and on the other side, depending on position of rotor (17), it can be connected with arm (19) or with arm (20) of flow guide (18), whereas groove (9), on one side, is connected permanently with passage of port (7), and on the other side, depending on position of rotor (17), it can be connected with arm (21) or with arm (22) off low guide (18), wherein passage (12), depending on position of rotor (17), connects directly groove (8) or with groove (9), whereas passage (12) is connected with space (13) over a actuator piston (5), and passage (14), depending on position of rotor (17), connects directly with groove (10) or with groove (11), while passage (14) is connected with space (16) under the actuator piston (5) and, wherein a first set of grooves (8) and (9) is separated from a second set of grooves (10) and (11) by a sealing ring (23) with locks (24).

2. The device for supporting the process of press molding of finely fragmented materials by means of mechanical vibrations characterized in that a force unit comprises main actuator (29), hydraulic vibrator (37), yoke (36) of the lower body of main table (30), thrust table (31) of posts (35), four columns (32), lower punch plate (33), and punch (34), wherein a main actuator (29) transfers a quasi-static pressing force to main table (30) and further by means of four columns (32) to lower punch plate (33), whereas thrust table (31) is, permanently connected by means of posts (35) with the lower body yoke (36), while thrust table (31) carries hydraulic vibrator (37) permanently connected with thrust table (31), and a hydraulic vibrator transfers a additional dynamic force to lower punch plate (33), wherein groove (10), on one side, is connected permanently with passage of port (6), and on the other side, depending on position of rotor (17), it can be connected with arm (19) or with, arm (20) of flow guide (18), whereas groove (9), on one side, is connected permanently with passage of port (7), and on the other side, depending on position of rotor (17), it can be connected with arm (21) or with arm (22) off low guide (18), wherein passage (12), depending on position of rotor (17), connects directly with groove (8) or with groove (9), whereas passage (12) is connected with space (13) over a actuator piston (5), and passage (14), depending on position of rotor (17), connects directly with groove (10) or with groove (11), while passage (14) is connected with space (16) under the actuator piston (5), wherein a first set of grooves (8) and (9) is separated from a second set of grooves (10) and (11) by a sealing ring (23) with locks (24) and, wherein alternately distributed grooves (8) and (9) are tightly separated from each other by means of separators (25) located on circumference of the rotor (17) and pressed against the body (26) of a flow pulse generator (3) by means of the centrifugal force.

3. The device for supporting a process of press molding of finely fragmented materials by means of mechanical vibrations, comprising a main actuator (29) transferring a quasi-static pressing force to a main table (30) and further by means of four columns (32) to a lower plate (33) with a lower punch (38), wherein a hydraulic vibrator (37) transferring an additional dynamic force to the lower punch plate (33) is permanently connected with an intermediate thrust table (31), said thrust table (31) rigidly connected by means of posts (35) with a lower body yoke (36) and the quasi-static pressing force of the main actuator (29) is superposed by the additional dynamic force of the hydraulic vibrator (37), wherein the vibrator (37) comprises an actuator (4) with its piston (5) supporting the lower plate (33), said actuator (4) connected with a pulse generator (3) having a rotor (17) provided with a plurality of grooves, of which a groove (10), on one side, is connected permanently with passage of port (6), and on the other side, depending on position of the rotor (17), it can be connected with a first arm (19) or with a second arm (20) of a flow guide (18), whereas a second groove (9), on one side, is connected permanently with passage of other port (7), and on the other side, depending on position of the rotor (17), it can be connected with a third arm (21) or with the fourth arm (22) of the flow guide (18), wherein a passage (12), depending on position of the rotor (17), connects directly with groove (8) or with groove (9), whereas the passage (12) is connected with space (13) over the actuator piston (5), and other passage (14), depending on position of the rotor (17), connects directly with groove (10) or with groove (11), while the passage (14) is connected with space (16) under the actuator piston (5), and wherein the grooves (8) and (9) are separated from grooves (10) and (11) by a sealing ring (23) with locks (24).

4. The device for supporting a process of press molding of finely fragmented materials by means of mechanical vibrations, comprising a main actuator (29) transferring a quasi-static pressing force to a main table (30) and further by means of four columns (32) to a lower plate (33) with a lower punch (38), wherein a hydraulic vibrator (37) transferring an additional dynamic force to the lower punch plate (33) is permanently connected with an intermediate thrust table (31), said thrust table (31) rigidly connected by means of posts (35) with a lower body yoke (36) and the quasi-static pressing force of the main actuator (29) is superposed by the additional dynamic force of the hydraulic vibrator (37), wherein the vibrator (37) comprises an actuator (4) with its piston (5) supporting the lower plate (33), said actuator (4) connected with a pulse generator (3) having a rotor (17) provided with a plurality of grooves, of which a groove (10), on one side, is connected permanently with passage of port (6), and on the other side, depending on position of the rotor (17), it can be connected with a first arm (19) or with a second arm (20) of a flow guide (18), whereas a second groove (9), on one side, is connected permanently with passage of other port (7), and on the other side, depending on position of the rotor (17), it can be connected with a third arm (21) or with the fourth arm (22) of the flow guide (18), wherein a passage (12), depending on position of the rotor (17), connects directly with groove (8) or with groove (9), whereas the passage (12) is connected with space (13) over the actuator piston (5), and other passage (14), depending on position of the rotor (17), connects directly with groove (10) or with groove (11), while the passage (14) is connected with space (16) under the actuator piston (5), wherein the grooves (8) and (9) are separated from grooves (10) and (11) by a sealing ring (23) with locks (24), and wherein alternately distributed grooves (8) and (9) are tightly separated from each other by means of separators (25) located on circumference of the rotor (17) and pressed against the body (26) of the flow pulse generator (3) by means of the centrifugal force.

* * * * *